US006729245B2

(12) United States Patent
Clark

(10) Patent No.: US 6,729,245 B2
(45) Date of Patent: May 4, 2004

(54) FILL DOOR HAVING ANGLED MOVEMENT

(76) Inventor: Kenneth D. Clark, 3195 Regional Pkwy., Santa Rosa, CA (US) 95403

( * ) Notice: Subject to any disclaimer, the term of this patent is extended or adjusted under 35 U.S.C. 154(b) by 0 days.

(21) Appl. No.: 10/203,984

(22) PCT Filed: Feb. 20, 2001

(86) PCT No.: PCT/US01/05566

§ 371 (c)(1),
(2), (4) Date: Aug. 14, 2002

(87) PCT Pub. No.: WO01/61249

PCT Pub. Date: Aug. 23, 2001

(65) Prior Publication Data

US 2003/0010264 A1 Jan. 16, 2003

Related U.S. Application Data

(60) Provisional application No. 60/183,497, filed on Feb. 17, 2000.

(51) Int. Cl.[7] ..... F23M 7/00
(52) U.S. Cl. ..... 110/173 R
(58) Field of Search ..... 110/173 R, 181, 110/174, 175 R, 180, 179, 173 A, 173 B, 173 C; 126/190, 191, 197, 192, 194, 175 A, 176, 177, 178, 179; 220/845, 836, 810, 818; 376/203; 49/190, 191, 203, 255, 381, 385

(56) References Cited

U.S. PATENT DOCUMENTS 238,411 A * 3/1881 Lowell ..... 110/181
301,155 A * 7/1884 Haumerson ..... 110/173 R
510,786 A * 12/1893 Harris ..... 110/175 R
521,447 A * 6/1894 Pickles ..... 110/175 R
1,537,093 A * 5/1925 Stoop ..... 110/165 R
1,759,882 A * 5/1930 Bilty ..... 292/210
2,271,411 A * 1/1942 Thwaits ..... 220/37
4,016,820 A * 4/1977 Johnson et al. ..... 110/173 R
4,883,002 A * 11/1989 Schuster ..... 110/173 R
5,158,043 A * 10/1992 Emsbo ..... 122/498
5,727,479 A * 3/1998 Mcafee et al. ..... 110/176

* cited by examiner

*Primary Examiner*—Kenneth B Rinehart
(74) *Attorney, Agent, or Firm*—Larry D. Johnson; Craig M. Stainbrook; Johnson & Stainbrook, LLP

(57) ABSTRACT

A fill door for use on the angled surfaces of furnace shells and chemical containers. The door is pivotally coupled to a door frame integral with the angled surface and includes a rim that mates with a female channel in the door. A U-shaped latch is pivotally connected to the frame and includes a threaded spindle operatively connected to crack. The surface of the door includes a female sleeve having a bore for accommodating the end of the spindle when the latch is over the door and the spindle is tightened into its closed and locked position. The door further includes a cantilevered arm having an angled bore which allows it to swivel around a substantially vertical cylindrical post connected to frame. The arm and door swing in a substantially horizontal plane around the axis of the post.

7 Claims, 5 Drawing Sheets

66
60
64
62
56
58
30
32
34
36
74
75
68
72
102
77
106
80
48
72
44
40
46
98
97
38
42
80
96
76
100
79
θ
70
104
16
94
82
86
90
54
88
94
84
52
18
50

FILL DOOR HAVING ANGLED MOVEMENT

This application claims the benefit of Provisional application Ser. No. 60/183,497, filed Feb. 17, 2000.

BACKGROUND OF THE INVENTION

1. Technical Field

The present invention relates generally to furnace and chemical vessel doors, and more particularly to a fill door having an angled movement.

2. Background Art

Furnace and chemical vessel fill doors are frequently set on an angled surface on a furnace or vessel shell. Positioning the door on an angled surface facilitates loading and transferring molten materials and dangerous chemicals. However, this positioning also makes manual movement of heavy doors difficult and occasionally impossible. It has been proposed to provide mechanical means, e.g., hydraulic or pneumatic, to assist in the door movement. This solution is needlessly costly and ultimately impracticable.

Furnace door designs generally are generally adapted for side wall positioning and address the need for thermal and gas tight fitting, while preferring mechanical operation. Recent examples include U.S. Pat. No. 4,883,002 to Schuster, which discloses a furnace closing mechanism for industrial furnaces composed of a furnace door latched to the furnace shell and a heat-insulating door fastened to inner side of the furnace door. The door is coupled to the door frame and furnace shell with a bayonet-type joint.

U.S. Pat. No. 5,727,479 to McAfee, et al., teaches an improved guillotine-style door closure system for a furnace that comprises an opening on the vertical side of a furnace, and a furnace door adapted to mate with the frame. The apparatus purportedly provides a uniform sealing forces along the entire door frame and prohibits the escape of gases between the seal and further prevents the crushing of ceramic fibers used for lining the doors.

The fill door of the present invention represents a solution to the above-described problem. The present invention comprises a center floating door on an angled hinge that allows the door to be opened and closed manually with very little effort and to be sealed after closing.

Many furnace designs include angled walls, and due to the advantages of this design it is desirable to fashion liquid-containing vessels similarly. However, to date doors for furnaces and vessels have developed for use on vertical and horizontal surfaces and to provide vertical and horizontal closures. When the door is heavy, because of the need for a thermal and gas tight closure, vertical and horizontal door motions (which require some measure of lifting and holding of the door) can become difficult and necessitate mechanical assistance.

Accordingly, there remains a need for a fill door having an angled movement, such that the door can be positioned on an opening on an angled surface while yet providing substantially level horizontal movement of the door.

DISCLOSURE OF INVENTION

The present invention is a fill door adapted for use on the angled surfaces of furnace shells or chemical containers. The door is pivotally coupled to a door frame which is integral with the angled surface. The frame includes a rim surrounding a furnace opening and mates with a female channel in the door. A U-shaped bracket latch is pivotally connected to the frame. The latch includes a threaded spindle operatively connected to a crank. The surface of the door includes a female sleeve which has a bore for accommodating the end of the spindle when the latch is over the door and the spindle is tightened into its closed and locked position. The door further includes a cantilevered arm having an angled bore which allows it to swivel around a substantially vertical cylindrical post connected to frame. The arm and thus the door swings in a substantially horizontal plane (i.e., a plane substantially 90 degrees relative to the axis of the post).

BEST MODE FOR CARRYING OUT THE INVENTION

Figure 1A:
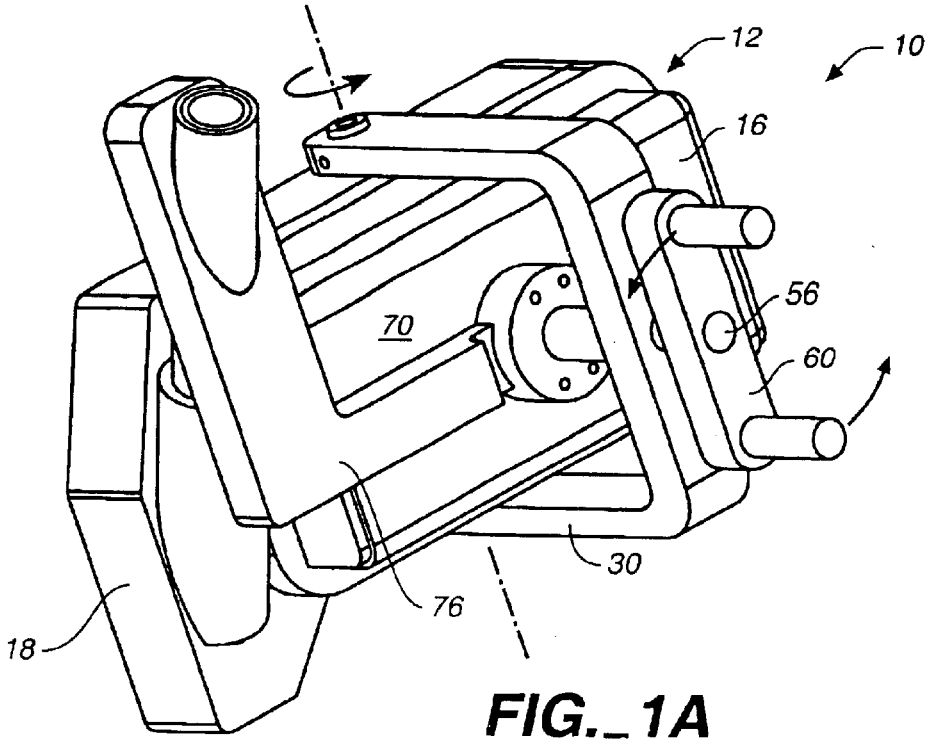
FIG. 1A is a perspective view of the fill door having angled movement of the present invention, showing the door in its closed and latched configuration.
Figure 1B:
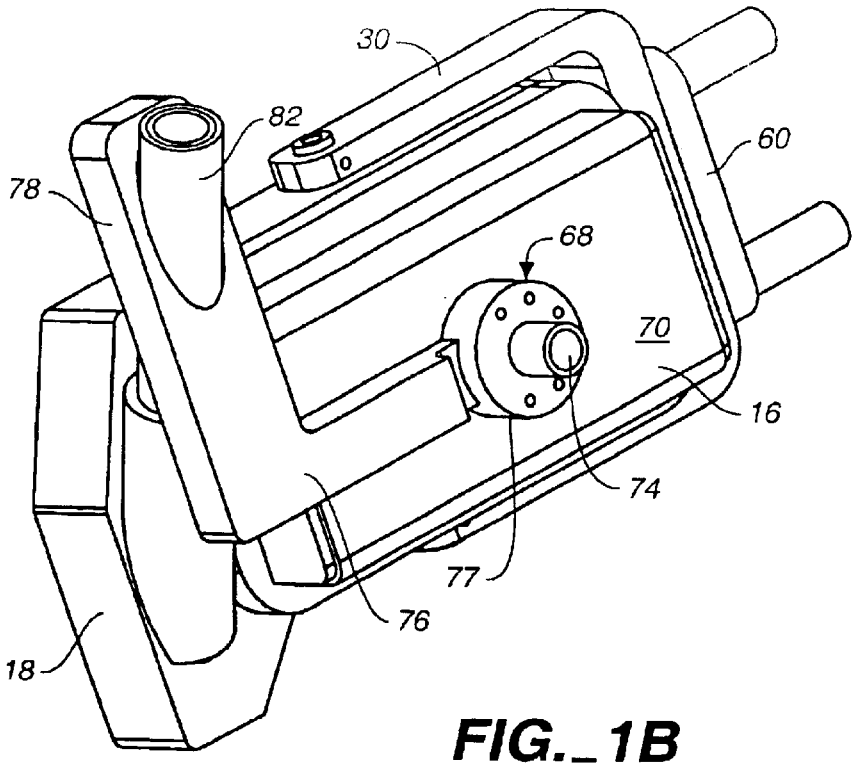
FIG. 1B is a perspective view of the present invention showing the door in its unlatched but closed position.
Figure 1C:
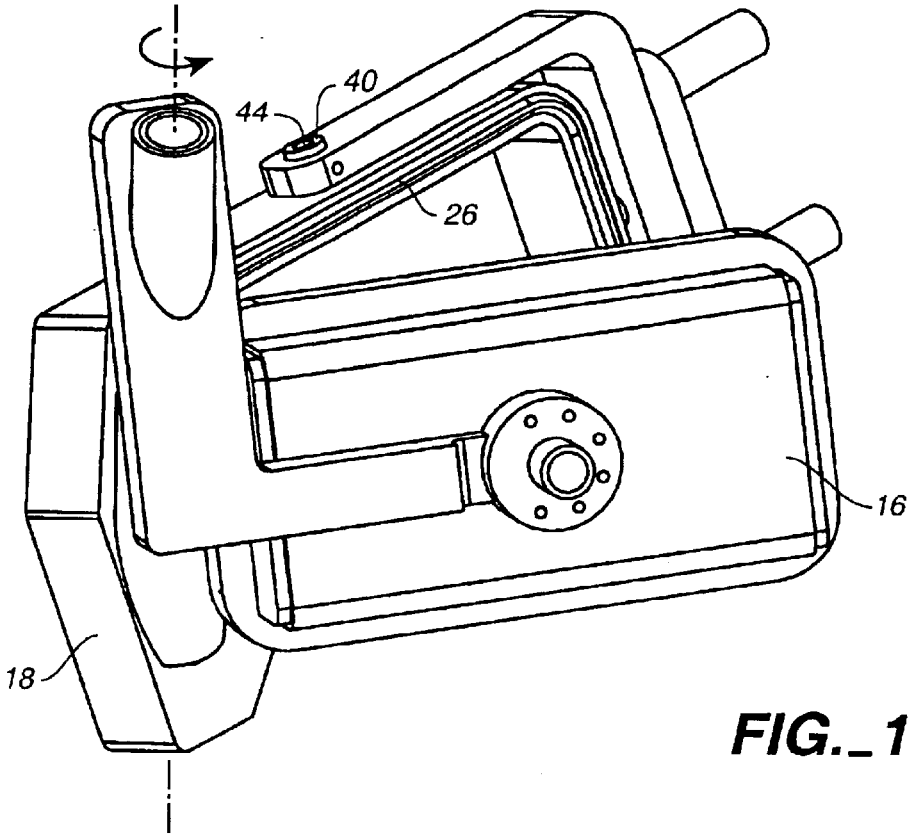
FIG. 1C is a perspective view of the door of FIGS. 1 and 2, showing the door partly opened.
Figure 1D:
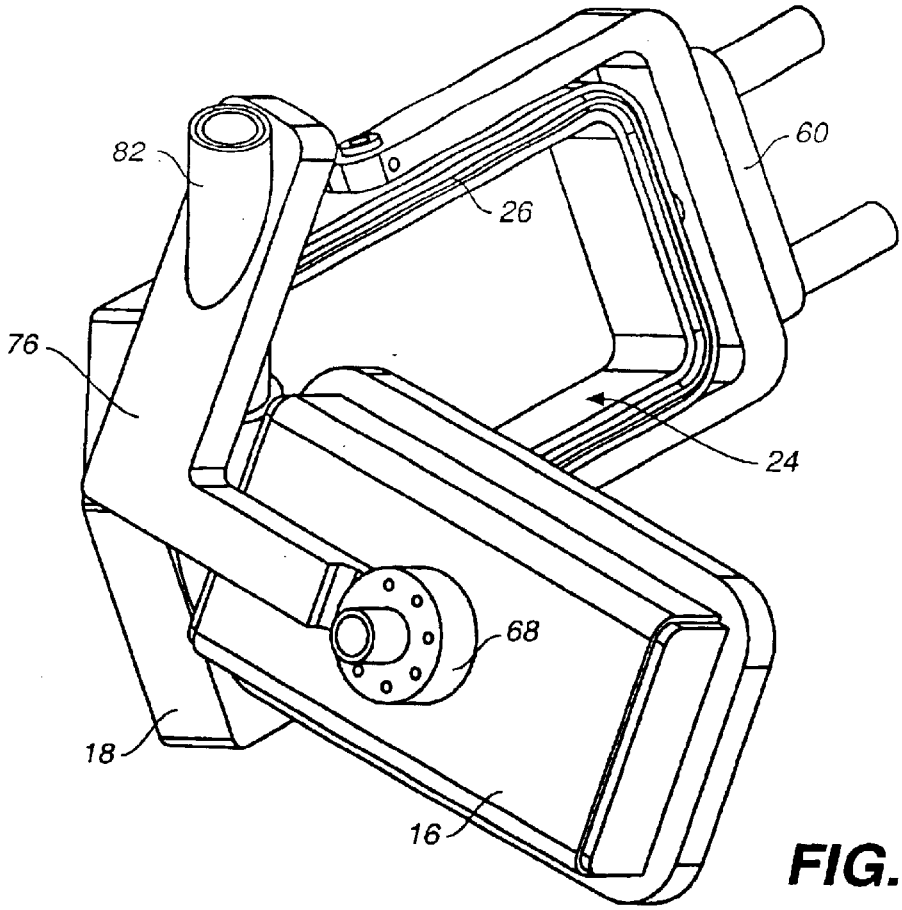
FIG. 1D is a perspective view of the inventive door, showing the door open approximately 90 degrees relative to its frame.
Figure 1E:
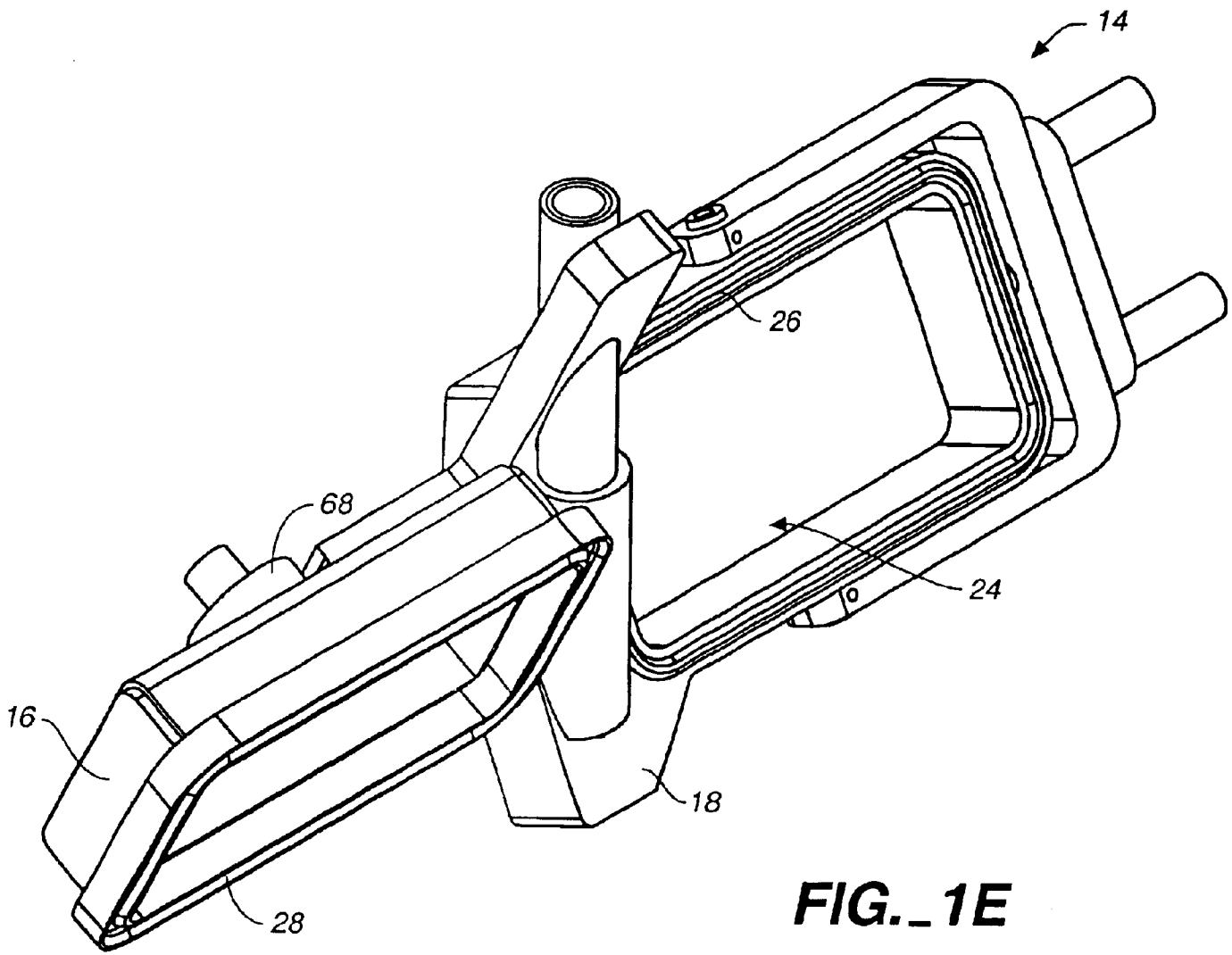
FIG. 1E is a perspective view showing the door fully opened.
Figure 2A:
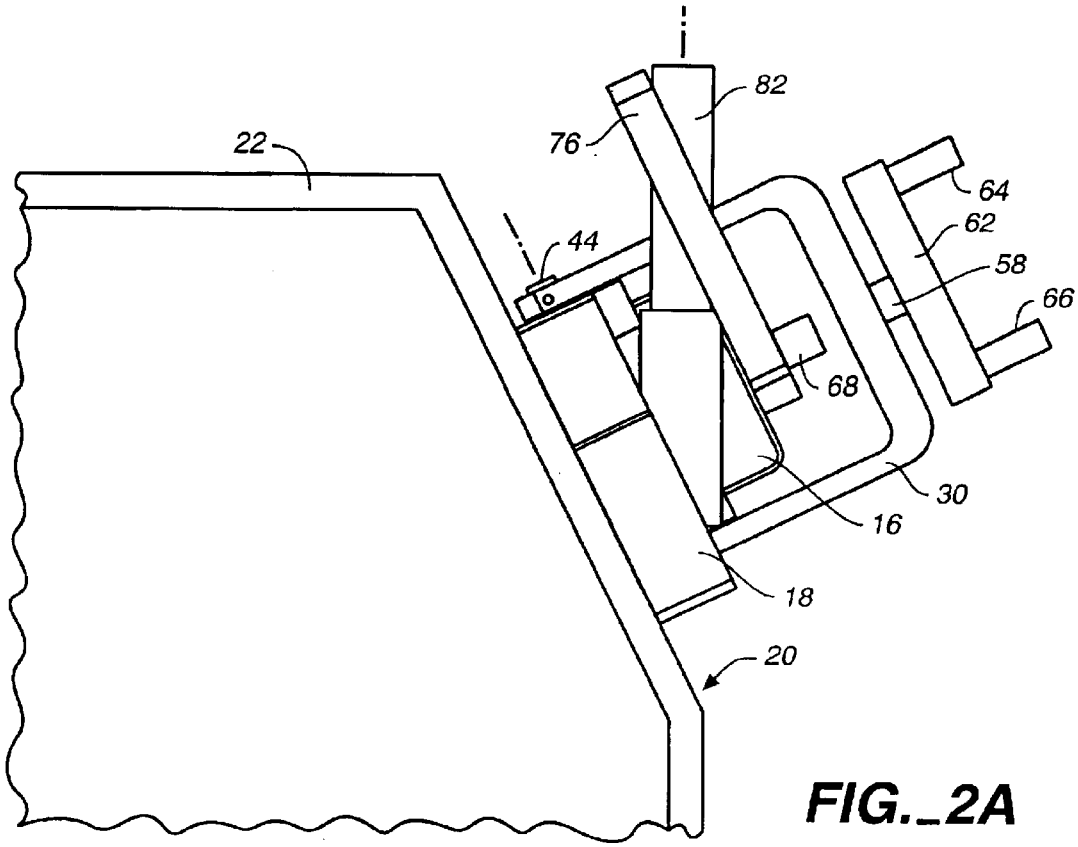
FIG. 2A is left side view in elevation view of the door of FIGS. 1*a–e*, showing the door in its latched position.
Figure 2B:
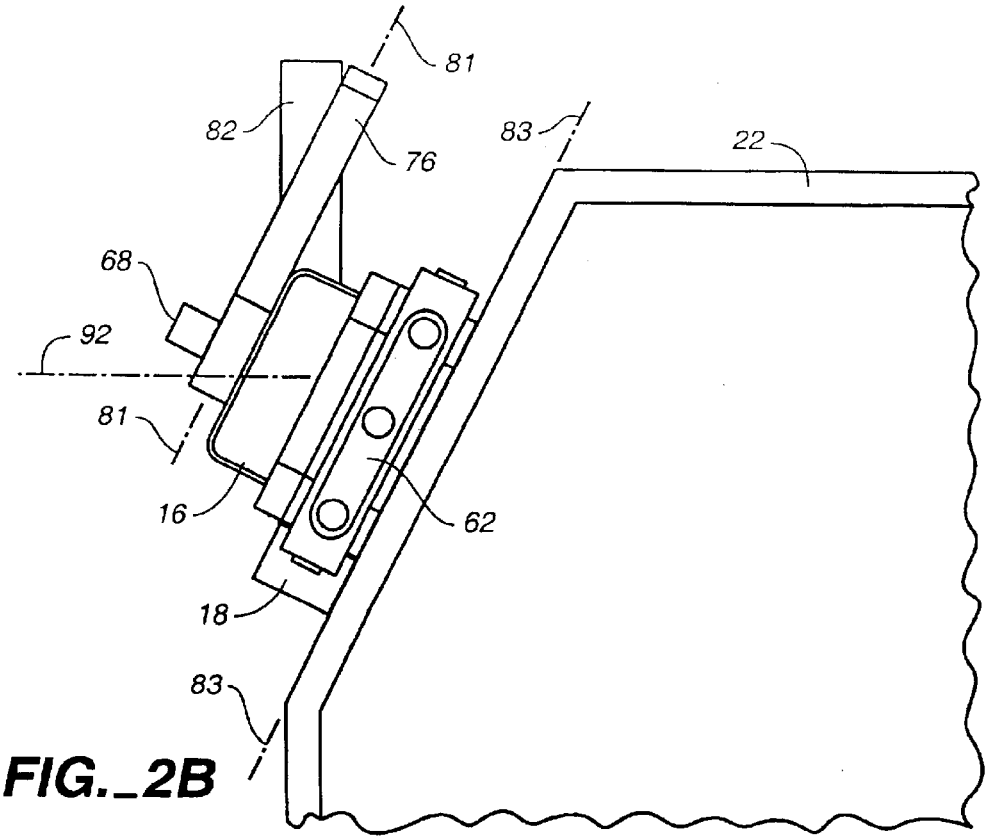
FIG. 2B is a right side view in elevation showing the door in its unlatched, closed position.
Figure 3:
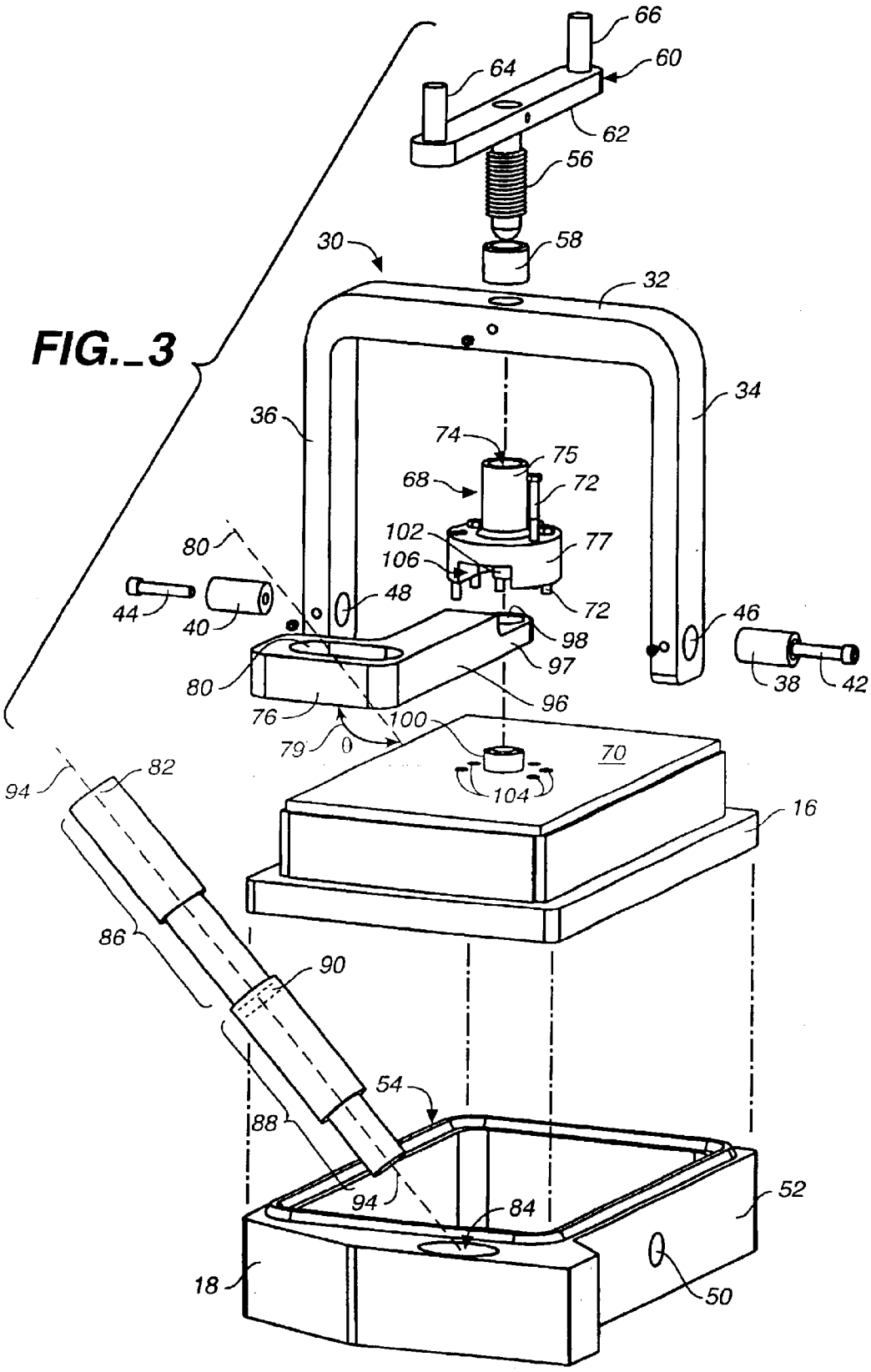
FIG. 3 is an exploded view of the inventive door showing its assembly and component parts.

Referring to FIGS. 1 through 3, wherein like reference numerals refer to like components in the various views, FIGS. 1A through 1E is a series of perspective views showing the furnace fill door 10 of the present invention in its closed configuration 12 (FIG. 1A), open configuration 14 (FIG. 1E), and further showing the movement of the door from the closed configuration to the open configuration (FIGS. 1B–D). The inventive apparatus comprises a door 16 and a door frame 18, said frame integrally formed and positioned on an angled surface 20 of a furnace shell or vessel 22 (FIGS. 2A–B) and defining an opening 24 providing access to the furnace or vessel interior. The frame 18 includes a male tongue or rim 26 preferably surrounding or substantially surrounding the furnace opening and adapted for precise mating with a female channel or slot 28 in door 16 to form a tongue-and-groove thermal and gas-tight coupling. Preferably the tongue-and-groove connection includes glass or ceramic fiber insulating material to provide a tight thermal and gas seal for furnaces or, alternatively, chemically inert deformable material to provide a seal suitable for use in chemical containment.

A U-shaped bracket latch 30 having a transverse member 32 and two arms 34, 36 is pivotally connected to frame 18 with a bushing 38, 40 and pin 42, 44 assembly, said pins and bushings inserted through apertures 46, 48 in the arms of latch 30 and into respective apertures 50 in the lower side 52 and upper side 54 (aperture not shown) of frame 18. The latch further includes a threaded spindle 56 inserted through a threaded sleeve 58, which is connected to transverse member 32, preferably welded, and threadably passes through transverse member 32. Operatively connected to spindle 56 is crank 60, which comprises a bar 62 and two rigid or, preferably, bearing-mounted handles 64, 66.

Door 16 includes a female sleeve 68 either integrally connected to the outer surface 70 of door 16 or bolted thereto with a plurality of bolts 72 and having a shallow bore 74 in a throat portion 75 for accommodating the end of spindle 56 when the latter is turned down into its closed position 12, and further having a base portion 77 for connection to door 16, said base portion 75 having a larger diameter than the throat portion 75.

The door 16 further includes a cantilevered L-shaped arm 76, preferably, though not necessarily, connected to said door at sleeve 68. At its cantilevered end 78, arm 76 includes an angled through bore 80 which allows the arm 76 to be fitted over and swivel around a cylindrical pivot post 82 proximate the door 16. The angle 79 of the through bore 80 is dictated by the angle of the vessel wall 22, inasmuch as the plane 81 of the arm is parallel to the plane 83 of the vessel wall. The pivot post is disposed substantially vertically from frame 18 and is preferably inserted into an angled aperture 84 in the frame. The pivot post may alternatively be affixed to the vessel wall rather than the door frame, though manufacture is simpler and structural integrity increased by having the post extend from the frame. Preferably pivot post 82 is divided into an upper moving half 86 and a lower stationary half 88, said upper half inserted into said lower half and said halves having a bushing 90 interposed between them so as to allow rotational movement of upper half 86. Alternatively, the angled bore 80 of arm 76 itself permits the arm to swing or swivel about post 82 such that door 16 swings on a substantially horizontal plane 92, i.e., a plane substantially 90 degrees relative to the longitudinal axis 94 of post 82, when moved either to or from its closed position. At the other end 96 of cantilevered arm 76 there is a tongue portion 97 having an aperture 98 into which a steel housing and ball bearing linkage 100 is inserted and secured for mating with a rod 102 integral with the base portion 77 of sleeve 68, such that arm 76 is interposed between sleeve 68 and door 16 before it is secured by bolts 72 threaded into complementary apertures 104 on the door, and such that the tongue portion 97 fits into a slot 106 integrally formed in base portion 77. (The housing and ball bearing linkage is well-known in the art and may be purchased off the shelf from several manufacturers, including F. K. Bearings, Inc., of Southington, Conn., USA.) When assembled, the tongue portion 97 of arm 76 has a small amount of space or play underneath sleeve 68, and the ball bearing linkage allows some swiveling and rotational movement in the door so that perfect tolerances in the assembly need not be achieved in order to provide a tight fit at closure.

As illustrated in FIGS. 1A–1E, to open the fill door of the present invention, crank 60 is turned in a counterclockwise direction until spindle 56 is entirely disengaged from sleeve 68. U-shaped bracket latch 30 is then swung over and against the furnace shell and away from the upper surface 70 of door 16. The door is now free to be opened and easily pivots around post 82. These actions are simply reversed to close the door, and complete closure is accomplished when spindle 56 is positioned over sleeve 68 and crank 60 is turned clockwise to thread spindle 56 into bore 74 to provide coupling pressure on the door. As may be readily appreciated, while the door remains angled, an operator positioned on the ground can effectively swing the door open and closed on a single level without the need to lift or hold the door at any point within its range of movement.

The configuration of operative structures in the present invention provides a barrier to the migration and transfer of heat from the furnace shell to the handle mechanism. This protects the operator from injury and obviates the need for lengthy cooling periods or mechanical operation.

While this invention has been described in connection with preferred embodiments thereof, it is obvious that modifications and changes therein may be made by those skilled in the art to which it pertains without departing from the spirit and scope of the invention. It will be readily appreciated that while the inventive door is particularly well adapted to industrial applications, the present disclosure teaches a closure system suitable for use in any of a number of environments, including, for example, structures requiring human ingress and egress. Thus, many of the elements that provide bulk and sturdiness to the inventive apparatus may either be eliminated altogether or replaced with lightweight counterparts while retaining the level movement accomplished by the combination of the cantilevered arm with the angled through bore and the vertically disposed pivot post. Accordingly, the scope of this invention is to be limited only by the appended claims.

What is claimed as invention is:

1. A fill door for attachment to industrial furnaces and chemical containment vessels, said comprising:

a door (16) having a closed position (12) and a fully open position (14);

a door frame (18), said frame positioned on an angled surface (20) of a vessel shell (22);

a substantially vertical cylindrical pivot post (82) proximate said door, and having an upper half (86) pivotally connected to a lower half (88); and an arm (76) affixed to said door and pivotally connected to said post (82);

characterized in that said door moves from its closed position to its fully open position in a horizontal plane.

2. The fill door of claim 1, wherein a bushing (90) is interposed between said upper half (86) and said lower half (88).

3. A fill door for attachment to industrial furnaces and chemical containment vessels, said door comprising:

a door (16) having a closed position (12) and a fully open position (14);

a door frame (18), said frame positioned on an angled surface (20) of a vessel shell (22);

a substantially vertical cylindrical pivot post (82) proximate said door; and an arm (76) affixed to said door and pivotally connected to said post (82), wherein said arm (76) has a tongue portion (97) having an aperture (98) into which a steel housing and ball bearing linkage (100) is inserted and secured, and wherein said linkage mates with a rod (102) integral with the base portion (77) of said sleeve (68), and wherein said arm (76) is interposed between said sleeve (68) and said door (16) such that said tongue portion (97) of arm 76 has a small amount of play underneath sleeve (68), and said ball bearing linkage allows some swiveling and rotational movement in the door;

characterized in that said door moves from its closed position to its fully open position in a horizontal plane.

4. A fill door for attachment to industrial furnaces and chemical containment vessels, said door comprising:

a door (16) having a closed position (12) and a fully open position (14);

a door frame (18), said frame positioned on an angled surface (20) of a vessel shell (22);

a substantially vertical cylindrical pivot post (82) proximate said door; and an arm (76) affixed to said door and pivotally connected to said post (82);

a U-shaped bracket latch (30) having a transverse member (32) and two arms (34, 36), each arm pivotally connected to said frame (18) frame;

a rotatable threaded spindle (56) threadably inserted through a threaded sleeve (58), which is connected to said transverse member (32); and a female sleeve (68) bolted to the outer surface (70) of door 16 with a plurality of bolts (72) and having a shallow bore (74) for accommodating the end of spindle (56) when the latter is rotated down to secure said latch (30) when said door (16) is in the closed position (12);

characterized in that said door moves from its closed position to its fully open position in a horizontal plane.

5. The fill door of claim 4, wherein said female sleeve (68) includes a throat portion (75) and a base portion (77), wherein said throat portion includes said shallow bore (74) and said base portion is bolted to said door (16).

6. The fill door of claim 4 wherein said latch (30) includes an aperture (46, 48) in each of said arms (34, 36), and wherein said frame (18) includes apertures (50) aligned with said apertures (46, 48) in said arms, and wherein said pivotal connection of said latch to said frame is provided by a bushing (38,40) and pin (42, 44) assembly one each inserted into the aligned apertures (46, 48, 50).

7. The fill door of claim 4, further including a crank (60) operatively connected to said spindle 56, said crank comprising a bar (62) and two handles (64, 66).

* * * * *